United States Patent [19]

Elliott

[11] 4,322,251

[45] Mar. 30, 1982

[54] METHOD AND APPARATUS FOR VAPOR TREATMENT OF METALS

[75] Inventor: Douglas R. Elliott, East Cleveland, Ohio

[73] Assignee: Diamond Shamrock Corporation, Dallas, Tex.

[21] Appl. No.: 149,743

[22] Filed: May 14, 1980

[51] Int. Cl.[3] ..... B08B 5/00; C23G 5/02

[52] U.S. Cl. ..... 134/11; 134/31; 134/40; 134/107; 148/6.3

[58] Field of Search ..... 134/11, 31, 40, 107; 202/168, 169; 148/6.3; 165/63; 62/238.5, 238.6, 435

[56] References Cited

U.S. PATENT DOCUMENTS

| | | | |
|---|---|---|---|
| 1,961,867 | 6/1934 | Savage | 134/11 |
| 3,887,628 | 6/1975 | Beckers | 134/31 X |
| 3,935,899 | 2/1976 | Jolly | 165/63 X |
| 4,014,751 | 3/1977 | McCord . | |
| 4,029,517 | 6/1977 | Rand | 134/11 |
| 4,055,196 | 10/1977 | Kearney | 134/107 |
| 4,210,461 | 7/1980 | Moree et al. | 134/11 |

OTHER PUBLICATIONS

Waste Heat Management Guide Book-NBS Handbook, vol. 121, "Case Study", Feb. 1977, pp. 121-125.

*Primary Examiner*—Marc L. Caroff

*Attorney, Agent, or Firm*—Bruce E. Harang; James G. Watterson

[57] ABSTRACT

A method and apparatus for metal degreasing or metal phosphatizing that utilizes a low boiling point solvent. The apparatus comprises a vessel defining a reservoir of solvent and a zone of solvent vapor above the reservoir, and an external heat pump system having a heat-emitting section and a heat-absorbing section to provide the necessary heating and cooling for the vessel. Intermediate heat transfer fluid loops transmit heat between the vessel and the heat pump, and include reservoirs to inhibit the loss of thermal balance in the heat pump. Coolant fluid is circulated through the solvent reservoir to inhibit solvent evaporation when the apparatus is not being used.

7 Claims, 3 Drawing Figures

METHOD AND APPARATUS FOR VAPOR TREATMENT OF METALS

BACKGROUND OF THE INVENTION

The present invention relates generally to vapor generation and recovery systems and in particular, to vapor degreasing and phosphatizing apparatus.

Metal cleaning and phosphatizing are manufacturing processes often used by industry today. Metal cleaning is usually done by a vapor degreasing apparatus which generally comprises a tank or compartment having a reservoir for boiling solvent and a region for maintaining a vapor zone above the solvent reservoir. The vapor zone is controlled by cooling coils disposed a predetermined distance above the level of solvent, which condense the rising vapor and return it to the reservoir. Essentially, an equilibrium is established between the vaporizing and condensing solvent so that a closed system is established in which solvent escape from the apparatus is minimized.

In use, an article to be cleaned is either immersed in the boiling bath or merely passed through the vapor zone to effect cleaning. Alternatively, the article may be sprayed with liquid solvent while in the vapor zone. In both cases, as the article is lifted from the vapor zone, any solvent condensed on the surfaces of the article is evaporated. The article is then both clean and dry upon removal from the vapor degreasing apparatus.

Non aqueous, solvent based metal phosphatizing, although a process distinct from vapor degreasing, utilizes a very similar apparatus. Like metal degreasing, it requires a bath of boiling solvent or phosphatizing solution and the maintenance of a vapor zone above the reservoir. Articles to be treated are either immersed in the solvent directly or in the vapor zone for a predetermined time. As articles are removed from the apparatus, the solvent evaporates, leaving behind a protective phosphate residue or deposit. In both processes, the apparatus used must include a source of heat for the solvent reservoir and a source of cooling for the vapor condenser. In many prior art vapor degreasers, the solvent reservoir is heated by steam or electric heaters. The condenser is cooled by circulating cold water through the condenser coils. In most, if not all of these vapor degreasers, the hot and cold sources for the solvent bath and condenser, respectively, are not interrelated and both involve non-recoverable energy use.

In more recent vapor degreasers, it has been recognized that it would be advantageous to utilize the heat energy absorbed by the condenser for heating the solvent. It has been suggested that a heat pump be employed to remove heat from the vapor condenser and convey it to the solvent reservoir. Devices have been constructed embodying this concept which utilize a heat-emitting section of the heat pump (more commonly called a refrigerant condenser) to heat the solvent reservoir, and a heat absorbing section of the heat pump system (commonly called an evaporator) to condense the solvent vapor and define the vapor zone. Structurally, the vapor degreaser would include a conventional tank or compartment defining, in part, a solvent reservoir. A heat exchanger forming the heat-emitting portion of the heat pump system would be disposed in the solvent reservoir. High pressure refrigerant circulated and subsequently condensed in the heat exchanger would heat the solvent.

The vapor condenser, on the other hand, being in actuality a refrigerant evaporator, would receive liquid refrigerant from the heat pump system through an expansion valve and evaporate it to provide cooling for the vapor condenser. The evaporating refrigerant would absorb heat from the condensing vapor, and upon re-compression by the heat pump compressor, would release this heat in the heat-emitting section of the heat pump system. It should be apparent that a heat pump associated with the vapor degreaser could provide an energy efficient vapor degreasing system.

Commercial vapor degreasers utilizing a heat pump system for a source of energy have not been entirely satisfactory. In many systems, excessive system startup time at the commencement of a work day has been experienced. For the heat pump system to operate efficiently, the heat absorbed by the vapor condenser should substantially equal the heat released by the heat emitting section. When the vapor degreaser is first turned on, little or no solvent vapor is available from which the vapor condenser can absorb heat, resulting in incomplete refrigerant evaporation in the vapor condenser. As a result, less heat is available for transfer to the heat-emitting section of the heat pump system; and thus, the time needed to bring the solvent to the boiling point can be excessively long. Moreover, a substantial thermal load imbalance across the heat pump may occur during this startup phase, resulting in compressor cycling or shutdown. To obviate this startup problem, it has been suggested that auxiliary electric heaters be placed in the solvent bath to initially heat the solvent at system startup. This increases energy consumption.

A second problem associated with heat pump vapor degreasers is the thermal imbalance caused by the heat load placed on the system by the articles being treated. It has been found that if the temperature of the articles being treated varies, system stability is adversely affected. This often occures where articles are stored both indoors, at ambient temperatures, and outdoors at substantially lower temperatures. It was found that the vapor degreaser could not accommodate the abrupt change in temperature caused by the articles being treated.

A third problem is related to the type of solvent used. One of the most common solvents in use today is trichloroethylene having a boiling point of approximately 188° F. The rather high reservoir temperature necessary to boil this solvent requires that the heat emitting section of the heat pump be operated well above the boiling temperature of the solvent. Obtaining temperatures in excess of 200° F. from a heat pump system requires rather sophisticated and clostly refrigeration equipment. Furthermore, as the difference in the vaporizing and condensing temperatures for the degreasing solvent increases, the work efficiency of the heat pump decreases. For this reason, methylene chloride, having a boiling point lower than 120° F., has been suggested as an alternate solvent for vapor degreasers employing the heat pump as a source of heating and cooling. The relatively low boiling point of methylene chloride requires a well balanced vapor degreasing system to minimize solvent escape, especially in high temperature environments often encountered in manufacturing plants. Even minor thermal imbalances must be avoided to avoid substantial solvent loss from the degreasing compartment. Prior art vapor degreasers utilizing direct heat exchange between the respective heat pump sections and the solvent reservoir and vapor condenser could not provide the necessary system stability, particularly in larger degreasing units.

Fourthly, although methylene chloride like other halogenated solvents when first introduced into the reservoir is chemically neutral, during use it often takes on corrosive properties and can attack the hardware and plumbing of the degreaser. In systems where the heat pump refrigerant is circulated through a heat exchanger immersed in the solvent reservoir, failure of the plumbing or heat exchanger could result in the release of toxic refrigerant into the atmosphere. Thus, known degreasers using a heat pump as a source of heating and cooling have not been totally acceptable when methylene chloride is used as a degreasing solvent.

The same considerations apply to the metal phosphatizing process, for methylene chloride is often used as a constituent of the phosphatizing bath. Thermal equilibrium in the apparatus as well as solvent evaporation and plumbing corrosion are all factors in the process.

SUMMARY OF THE INVENTION

The present invention provides a method and apparatus for generating and maintaining a vapor zone for metal degreasing and metal phosphatizing processes and has special utility in those processes that employ a relatively low boiling point solvent such as methylene chloride as a constitutent. The invention employs a heat pump and provides a method for operating the system in conjunction with a vapor degreaser or metal phosphatizer that obviates the system startup and thermal instability problems of the prior art.

According to the preferred embodiment of the invention, an apparatus is disclosed that includes a vessel forming a reservoir or sump for a solvent to be heated and a zone for containing solvent vapor above the liquid solvent. A solvent heater is disposed in the solvent sump and a vapor condenser is disposed a predetermined height above the liquid solvent. A heat pump system having a heat-emitting and a heat-absorbing section outside the reservoir, communicates with an intermediate heat transfer system, which conveys heat from the heat emitting section of the heat pump system to a heat exchanger that forms the solvent heater. Preferably, the intermediate heat transfer system also conveys the heat accepted by the vapor condenser from the condensing vapor, to the heat absorbing section of the heat pump.

When the invention is embodied in a vapor degreaser that uses methylene chloride or other solvent having a similar low boiling point, efficient and economical operation is realized. Full advantage is taken of the energy saving characteristics of the heat pump while avoiding the system startup problems of the prior art. This is accomplished by the use of the intermediate heat transfer system. When the apparatus is first turned on, the heat transfer fluid is circulated through the vapor condenser and then cooled by the heat absorbing section of the heat pump. The heat removed is conveyed via the heat pump to the heat emitting section from where it is transferred through the intermediate heat transfer system to the heat exchanger in the solvent sump. The fluid of the intermediate system provides a source of heat for the heat absorbing section of the heat pump, even though solvent vapor is not available for condensing by the vapor condenser. Once the solvent in the sump begins to boil, the vapor generated will rise and release its heat to the vapor condenser and, hence, to the fluid communicating with the heat-absorbing section of the heat pump, thus providing a continuous source of heat for the heat pump system.

Of the low boiling point solvents available, methylene chloride is preferred for the disclosed apparatus and method. Like other solvents, it can become corrosive during use and for this reason a stabilizing compound preferably propylene oxide is added to inhibit changes in the solvent. This stabilizing agent has little or no effect on the boiling point of methylene chloride.

The intermediate heat transfer system is divided into a separate heating and cooling circuit. Each circuit includes fluid handling conduits and an associated pump for circulating a fluid, preferably a water mixture, between the vapor degreaser (or metal phosphatizer) and respective heat transfer sections of the heat pump. Specifically, the heating circuit circulates water between the solvent heat exchanger and the heat emitting section of the heat pump. The cooling circuit circulates water between the vapor condenser and the heat absorbing section of the heat pump.

According to a feature of the invention, the heating and cooling circuits of the intermediate heat transfer system include fluid reservoirs for inhibiting the loss of thermal equilibrium in the heat pump system. These reservoirs supply inertia to the system so that fluctuations in the heat load, caused by articles of differing temperatures, do not adversely affect the equilibrium or vapor zone above the solvent sump. These fluid reservoirs isolate the heat pump system from the abrupt changes in the heating and cooling demand experienced during the actual operation of the apparatus. In this way, the thermal balance in the heat pump system is preserved, even though heat demand fluctuations are present.

The reservoir in the cooling circuit facilitates system startup by supplying a source of heat for the heat pump until vapor is generated. For this reason its capacity is selected as a function of the specific heat of the solvent and the capacity of the solvent reservoir. When the capacity of this coolant reservoir is properly selected, the temperature of the coolant in the cooling circuit will be reduced from room or ambient temperature to the desired cooling temperature in the time it takes the solvent in the sump to be raised to the requisite boiling temperature. Startup of the vapor degreaser or metal phosphatizer will thus proceed quickly and without introducing thermal imbalance in the heat pump.

Another feature of the invention is the inclusion of conduits and valving for diverting coolant fluid (e.g., cooled water) from the vapor condenser to th solvent sump to cool the liquid solvent and thus inhibit solvent evaporation during apparatus non-use. The cooling water is preferably circulated through the solvent heat exchanger to obviate the need for additional plumbing and hardware. To accomplish this feature, the flow of heated water from the heat emitting section of the heat pump is terminated while concurrently communicating the solvent heat exchanger with the diverted coolant flow.

The solvent heating circuit preferably includes an auxiliary heat exchanger for dissipating the excess heat, which during normal operation, is injected into the sytem by the mechanical work energy of the heat pump. Additionally, the auxiliary heat exchanger provides the necessary heat dissipation for the heating circuit when cooling fluid is being diverted to the solvent heat exchanger. Temperature responsive controls preferably monitor the temperature of fluid leaving the auxiliary heat exchanger and change the heat dissipation rate of the heat exchanger accordingly.

As a further feature of the invention, the solvent heater is configured to further minimize solvent loss by the apparatus. In a preferred embodiment, the solvent heat exchanger comprises a plurality of vertical plates disposed near the perimeter of the solvent reservoir. Each of the plates includes substantial surface areas so that a more uniform boiling of the reservoir is produced. Moreover, the perimeter location of the plates in combination with the perimeter location of the condenser coils is believed to minimize solvent loss because the somewhat higher vapor rise velocity which is generated immediately above the heat exchange plates is countered by the increased cooling available near the perimeter of the tank provided by the cooling coils.

A more complete understanding of the invention will be obtained from the following detailed description, considered in connection with the accompanying drawings.

DESCRIPTION OF THE PREFERRED EMBODIMENT

Figure 1:
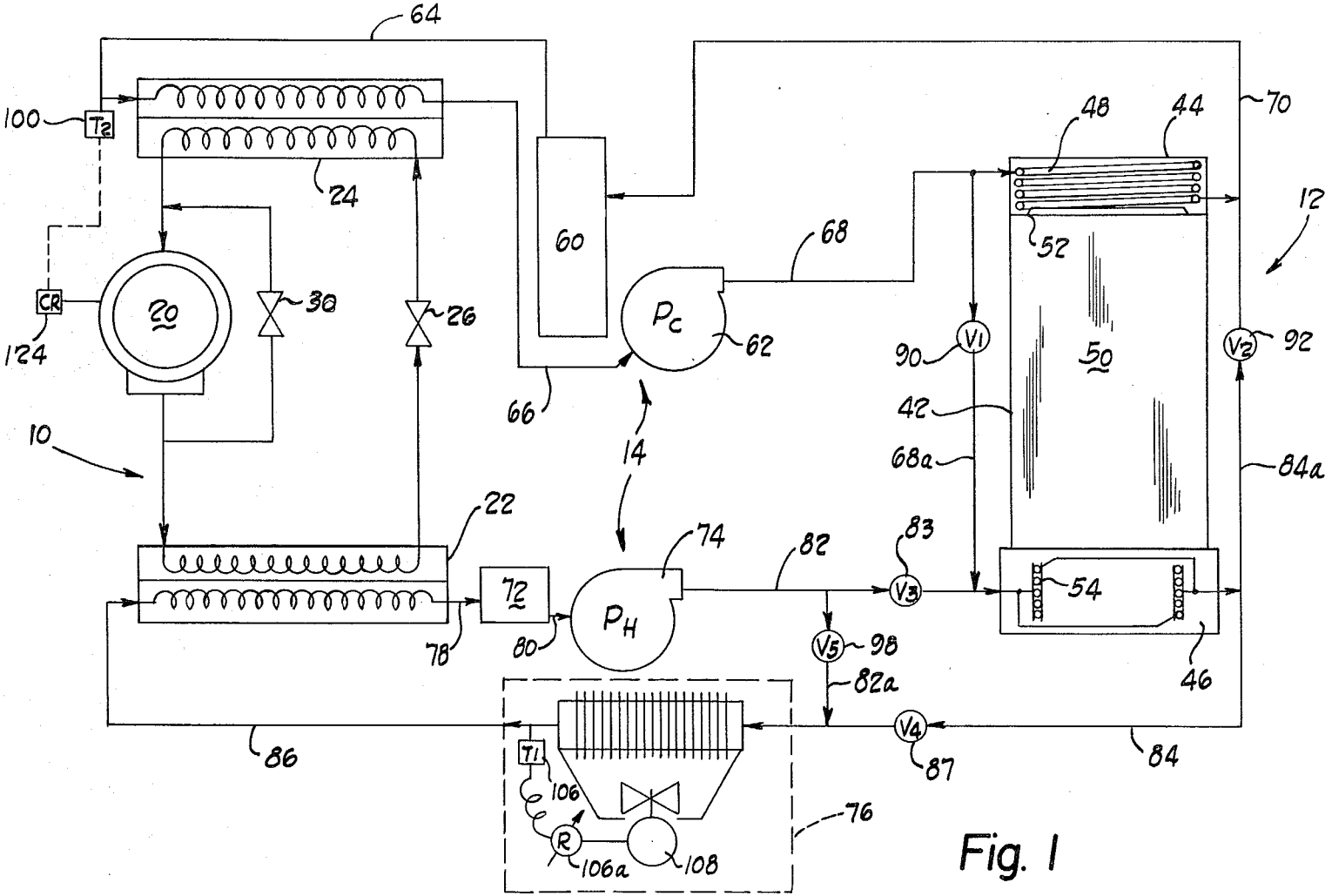
FIG. 1 is a diagrammatic representation of a metal treating apparatus, usable as a vapor degreaser or phosphatizer, constructed in accordance with the present invention.

FIG. 1 diagrammatically illustrates the overall construction of a metal treating apparatus constructed in accordance with a preferred embodiment of the present invention that can be used either as a vapor degreaser or a metal phosphatizer. It comprises a heat pump system 10, a degreasing or phosphatizing tank 12, and an intermediate heat transfer system that transmits heat between the heat pump system 10 and the degreasing tank 12.

The heat pump system 10 is conventional and includes a refrigerant compressor 20, a refrigerant condenser and a refrigerant evaporater, the latter two in the form of liquid-type heat exchangers 22, 24, respectively. The heat exchangers 22, 24 form the heat-emitting and heat-absorbing sections of the heat pump system 10, respectively. Refrigerant, typically a chlorofluorocarbon liquid like Freon 12, Freon 22 or Freon 502 (products of E. I. DuPont de Nemours), is compressed by the compressor 20 and pumped to the condenser/heat exchanger 22 where it condenses and releases heat to heat exchange fluid communicating with the heat exchanger 22. The liquid Freon leaving the heat exchanger 22 travels to, and is vaporized in, the evaporator/heat exchanger 24, vaporizing being facilitated by an expansion valve 26. The vaporizing Freon in turn absorbs heat from heat exchange fluid communicating with the heat exchanger 24, the heat absorbed substantially equalling the heat of vaporization released by the Freon in the condenser/heat exchanger 22. It will be recognized by those skilled in the art that the heat released in the heat exchanger 22 will be greater than that absorbed in the heat exchanger 24 because the heat released includes both the heat of vaporization and the heat added to the Freon by the mechanical work energy of the compressor.

The heat pump system also includes conventional pressure responsive switches for interrupting power to the compressor if an excessively high or low head pressure is encountered. A conventional hot-gas bypass valve 30 is provided between the high pressure circuit and suction circuit for communicating hot gas to the evaporator side of the heat pump system to compensate for incomplete Freon vaporization and low compressor head pressure.

The vapor degreasing tank is an upstanding vessel 42, having an open top 44. The lower end of the tank forms a solvent reservoir 46, more commonly referred to as a sump. Cooling coils 48 forming a vapor condenser are positioned perimetrically, near the top of the vessel 42 and in operation define a vapor zone 50 that extends above the solvent and terminates at the cooling coils 48. A perimetric trough 52 extends from the sidewall of the vessel immediately below the cooling coils 48 and collects condensate that drops from the coils. It will be recognized by those skilled in the art that the collected condensate can be conveyed directly to the solvent sump 46 or alternately to a water separator (not shown) and then to the solvent sump or other solvent container. According to the invention, methylene chloride is the preferred solvent. To prevent solvent degradation, specifically the taking on of corrosive properties, a stabilizing compound, preferably propylene oxide is added. This agent inhibits corrosive changes in the methylene chloride during use with little or no effect on the solvent's boiling point.

Figure 2:
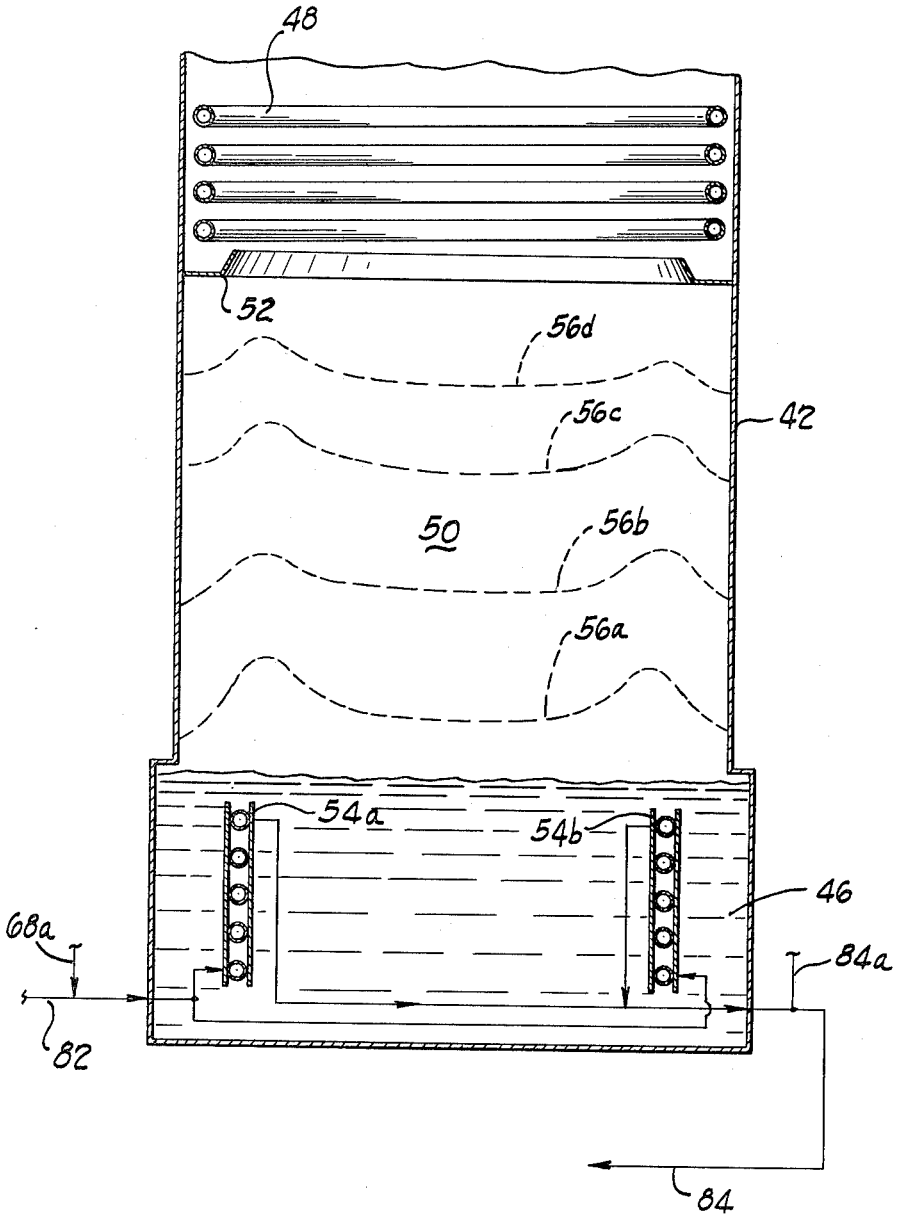
FIG. 2 is a diagrammatic view of a treating tank incorporating features of the present invention.

The solvent in the reservoir 46 is heated and boiled by a solvent heater 54 which is immersed and preferably covered by the solvent. In the preferred embodiment, the solvent heater 54 is a heat exchanger that communicates with the intermediate heat transfer system 14. As seen in FIG. 2, the heat exchanger 54 comprises a pair of heat exchanger plates **54*a*, 54*b* positioned near the perimeter of the vessel 42** and preferably in vertical alignment with the cooling coils along the same sidewall region of the vessel.

The disclosed placement of the heat exchanger plates **54*a*, 54*b* is believed to advantageously reduce solvent losses in the vapor degreaser. In prior degreasers, the reservoir heater is usually centrally positioned. Consequently, it is theorized that the attendant high vapor velocity immediately above the reservoir heater will be generated substantially in the center of the vapor degreasing tank where the cooling provided by the condensing coils is least effective. In the present invention, the high vapor velocity above the heating elements 54*a*, 54*b* will be generated near the perimeter of the vessel 42 and will rise in close proximity to the cooling coils 48, in a vicinity where cooling is most effective. For purposes of illustration, the vapor velocity gradient in the vapor zone 50 is depicted by the family of broken lines 56*a*–56*d* in FIG. 2. As shown, the velocity peaks occur near the sidewalls and travel vertically towards the cooling coils 48**. In this way, solvent escape from the tank is advantageously minimized.

Referring again to FIG. 1, the intermediate heat transfer system 14 couples the cooling coils 48 to the evaporator/heat exchanger 24 and the solvent heater 54 to the condenser/heat exchanger 22. Accordingly, it includes separate heating and cooling circuits for accomplishing the heat transfer between the heat pump system and the respective components in the vapor degreasing tank 12.

The cooling circuit includes a reservoir 60, a fluid pump 62 and connecting conduits. In the preferred embodiment, a conduit 64 connects the output of the reservoir 60 with the input of the heat exchanger 24. The output of the heat exchanger is connected to the input of the fluid pump 62 by a conduit 66. The pump 62 delivers coolant to the cooling coils 48 by a conduit 68. The coolant returns from the coils 48 via a conduit 70.

The heating circuit of the intermediate heat transfer system 14 is very similar to the cooling circuit and comprises a reservoir 72, a fluid pump 74 and a supplementary heat exchanger 76, connected to each other and the other system components by a plurality of fluid handling conduits. In the heating circuit, the output of the condenser/heat exchanger 22 communicates with the input to the reservoir 72 through a conduit 78. The output of the reservoir is fed to the fluid pump 74 by a supply conduit 80. Heated fluid is delivered to the solvent heat exchanger 54 from the pump 74 by a supply conduit 82 that includes a flow control valve 83. The heating fluid, returning from the solvent heat exchanger 54 passes through the supplementary heat exchanger 76 before entering the condenser/heat exchanger 22. Conduits 84, 86 connect the solvent heat exchanger 54, the supplementary heat exchanger 76 and the heat exchanger 22. The conduit 84 also includes a flow control valve 87.

The disclosed apparatus is especially suited for degreasing and phosphatizing processes that use a relatively low boiling point solvent, such as methylene chloride, in the degreasing or phosphatizing tank 12. For solvents having a boiling point in the range of 80° F. to 130° F., a mean heating fluid operating temperature of about 135° F. and a mean coolant operating temperature of about 40° F. have been found to adequately minimize solvent escape during operation. Due to the moderate fluid temperatures required, water is the preferred fluid for both the cooling and heating circuits of the intermediate heat transfer system 14, although other fluids, e.g. brine and glycols such as ethylene glycol could be serviceable. It should be appreciated, that various stabilizing and anti-freezing compounds could be added to the water to prevent corrosion etc., in the conduits and other components.

The use of fluid heat exchange water loops between the heat pump system and the degreasing or phosphatizing vessel is an important feature of the invention. The fluid loops facilitate the initial system startup and buffer heat demand fluctuations that normally occur in the tank 42 so that the heat pump system is not subjected to wide vacillations in heat demand. Those skilled in the art will recognize that a heat pump system operates most efficiently when its heat output is substantially equal to its heat input (ignoring the heat attributable to the mechanical work energy of the compressor). If a substantial heat imbalance occurs, most conventional compressors will shut down due to the operation of one or more associated equipment safety controls. It should be apparent, that to maintain heat pump efficiency, heat balance is imperative.

To expedite system startup, the coolant reservoir 60 is critically sized so the coolant will reach its normal operating temperature in the time interval it takes the solvent reservoir to reach its boiling temperature. As mentioned earlier, at initial system startup, solvent vapor is absent from the vapor zone 50 and thus a source of heat for the vapor condenser 48 is unavailable. In order for the heat pump system 10 to operate efficiently, the coolant entering the heat exchanger 24 through conduit 64 must be at a temperature high enough to effect complete refrigerant vaporization. If the coolant temperature entering the heat exchanger 24 is too low, some of the refrigerant will remain in the liquid state and cause a substantial heat imbalance in the heat pump, resulting in compressor shut down. When water is used as a coolant, the problem is further compounded, for if the evaporator temperature is allowed to get too low due to insufficient heat absorption by the degreaser condenser 48, heat exchanger freezing and icing can occur, again resulting in system shut down. In order to obviate these conditions, the coolant reservoir 60 is sized so that the heat pump is provided with a temporary source of heat during the system startup, the source of heat being the coolant at room or ambient temperature.

The size of the reservoir 60 is related to the volume of solvent in the solvent reservoir 46, its boiling point and its specific heat. To calculate the appropriate size for the reservoir, the system's startup heat requirement must be determined. System startup heat can be derived from the following equation:

$$\text{Startup heat} = M_S C_S (T_S - T_i) + M_{HF} C_{HF} (T_{HF} - T_i)$$

Where $M_S$ is the mass of the solvent in the solvent reservoir; $C_S$ is its specific heat and, $T_S$ is its boiling point. $M_{HF}$ is the total mass of the heating fluid (water in the preferred system) in the heating circuit of the intermediate heat transfer system 14 and $C_{HF}$ is its specific heat. $T_{HF}$ is the temperature of the heating fluid at the input to the solvent heater 54 during normal operation. $T_i$ is the initial (usually ambient) temperature of the solvent and/or heating fluid prior to startup and is typically between 40° F. and 135° F.

Once the startup heat for the system has been determined, the amount of coolant needed in the coolant loop of the intermediate heat transfer system 14 can be determined from the following equation:

$$M_C = \text{Startup heat}/[C_C(T_i - T_C)] \times H_{COND}/H_{TOT}$$

Where $M_C$ is the mass of coolant in the coolant loop and $C_C$ is its specific heat. $T_C$ is the desired operating temperature of the coolant at the inlet to the vapor condenser 48 and $T_i$ is the initial or ambient temperature of the coolant prior to startup. It should be noted that the terms: $(T_S - T_i)$, $(T_{HF} - T_i)$ and $(T_i - T_C)$ can be alternately expressed as $\Delta T_S$, $\Delta T_{HF}$ and $\Delta T_C$, respectively.

$H_{COND}$ is the heat absorbed by the vapor condenser during normal operation and determines the rate at which vapor is condensed (gallons per hour) and thus, the cleaning capacity of the degreaser. $H_{COND}$ is usually a known quantity. $H_{TOT}$ is the total heat discharged into the heat pump condenser/heat exchanger 22 by the heat pump and generally $$H_{TOT} = H_{COND} + H_{COMP}$$

Where $H_{COMP}$ is the heat added to the refrigerant by the mechanical work energy of the compressor. $H_{COMP}$ is usually equal to the electrical power consumption of the compressor.

The term $H_{COND}/H_{TOT}$ is related to the efficiency of the heat pump system and represents the ratio between the heat absorbed by the vapor condenser and the total heat added to the solvent bath. In an ideal heat pump the heat absorbed by the evaporator/heat exchanger 24 equals the heat discharged into the heat exchanger 22. In an actual system, the compressor 20 can contribute a significant amount of heat as a result of work energy consumed by the compressor. This work energy is also discharged into the heat exchanger 22.

Put another way, for an ideal system $H_{COMP}$ approaches zero and the term $H_{COND}/H_{TOT}$ is unity and drops out of the above equation. For an actual operating system, the term $H_{COND}/H_{TOT}$ can be as low as 0.5. If the ratio between $H_{COND}$ and $H_{TOT}$ is less than 0.5, the heat pump becomes an impractical source of heating and cooling for a vapor degreaser or phosphatizer. In any event, any heat contributed by the compressor ($H_{COMP}$) will manifest itself as a reduction in the amount of coolant required to support or facilitate system startup.

Once the required coolant mass has been calculated, the capacity (volume) of the reservoir 60 is determined by the total mass required, reduced by the mass of coolant in the conduits, valving, etc. Generally, the mass of coolant in the conduits and valving can be ignored for it constitutes a relatively insignificant amount. The volume of the reservoir 60 is then defined by the mass of coolant required multiplied by the density of the coolant.

In short, the capacity of the coolant reservoir 60 is determined by the heat necessary to raise the solvent from an ambient temperature to its boiling point. The capacity is reduced proportionally by any heat injected into the system by the heat pump compressor. The heat released by the reservoir when the coolant is reduced from ambient temperature to its operating temperature plus any heat injected into its system by the heat compressor must at least equal the heat required to raise the solvent temperature from ambient to its boiling point.

There are also upper limits on the size of the coolant reservoir 60. If the reservoir is too large, the coolant will not be cooled to the desired operating temperature and thus, vapor condensing will be impaired. The range of reservoir sizes that will function satisfactorily is determined primarily by the expected range of ambient temperatures. As the ambient temperature decreases, the mass of coolant required increases for it will take a greater amount of coolant to supply the necessary startup heat.

The volume of heating fluid in the heating circuit of the intermediate heat transfer system is not as critical. Preferably, the heating fluid reservoir 72 is minimally sized so that startup heat is minimized. Referring to the equations as discussed above, it should be noted that startup heat is a function of the amount of solvent in the solvent reservoir 46 and the volume of heating fluid in the heating circuit. If the heating fluid volume is increased so is the startup heat requirement and hence, the coolant reservoir 60 must also be enlarged. The heating fluid reservoir 72 provides inertia to the system and buffers the heat flow between the solvent heat exchanger 54 and the condenser/heat exchanger 22 so that heat demand fluctuations in the solvent sump 46 are not directly communicated to the heat pump system. For this reason, it need only be large enough to store the makeup heat necessary to correct the largest temporary thermal imbalance expected during normal operation.

As noted earlier, the heating circuit also includes a supplementary heat exchanger 76 disposed in the flow path intermediate the outlet of the solvent heater 54 and the inlet to the condenser/heat exchanger 22. The supplementary heat exchanger 76 serves a two-fold purpose. First, in normal operation, it exhausts the excess heat from the refrigerant contributed by the compressor and compensates for variations in the temperature of the heating fluid at the outlet of the solvent heater so that a relatively fixed liquid temperature at the inlet of the condenser/heat exchanger 22 is maintained. In this mode of operation, the supplementary heat exchanger 76 operates to preserve heat balance in the heat pump system 10.

Second, the supplementary heat exchanger 76 is utilized to achieve a second important feature of the present invention. In order to prevent solvent escape during apparatus nonuse, the present invention contemplates a method and apparatus for cooling the solvent sump 46 during apparatus idle periods. This feature is especially useful in manufacturing environments where the ambient temperature is quite high. The apparatus maintains the solvent temperature below the ambient temperature so that solvent evaporation is miminized. This solvent sump "cooling mode" is typically initiated at the end of a workday so that overnight solvent evaporation is inhibited.

To accomplish this feature, diverting conduits and associated valving are provided for communicating the coolant circuit of the intermediate heat transfer system 14 with the solvent heater 54. Specifically, a branch conduit **68*a* communicates with the heat supply conduit 82 through a flow control valve 90. A branch conduit 84*a* communicates the outlet of the heater 54 with the coolant return conduit 70 through a flow control valve 92. The flow control valves 83 and 87, disposed in the conduits 82, 84 respectively, are operative to terminate the flow of heating fluid to and from the heater 54. A branch conduit 82*a* communicates the heater supply conduit 82 with the heater return conduit 84 through a flow control valve 98. The valves 83, 87, 90, 92, and 98** are preferably electrically controlled, such as commonly available solenoid operated valves. When the valves are energized, fluid flow can proceed through each valve in its associated conduit. When deenergized, the valves prohibit fluid flow in their associated conduits.

When the tank 42 is being used to treat or clean material, the flow control valves 83, 87 are energized and the valves 90, 92 and 98 are de-energized. Thus, the valve 83 allows the heating fluid to proceed along the solvent heat supply conduit 82; the valve 87 allows the return flow of the heating fluid from the solvent heater along the return conduit 84. The de-energized valves 90 and 92 prevent the flow of coolant to the solvent heater 54. The de-energized valve 98 isolates the supply conduit 82 from the return conduit 84 so that all the heating fluid must pass through the solvent heater 54 before returning to the condenser/heat exchanger 22.

When the tank is not being used and it is desired to maintain the solvent temperature below ambient temperature, the solvent sump "cooling mode" is initiated. In this mode, the flow control valves 83, 87 are de-energized thereby isolating the solvent heat exchanger 54 from the heating fluid, supply and return conduits 82 and 84. The flow control valves 90, 92 and 98 are energized, thereby communicating the coolant conduits 68, 70 with the solvent heat exchanger 54. The energized valves 90, 92 communicate the coolant circuit with the solvent heater 54 and allow coolant to pass through the solvent heater. The coolant returns from the solvent heater 54 to the return conduit 70 by way of the branch conduit **84*a* and the valve 92. The valve 98 communicates the supply conduit 82 with the return conduit 84 and thus completes the heating fluid circuit. It should be noted, that in this mode of operation, the heating loop of the heat pump system does not communicate with the degreasing or phosphatizing tank 42. Thus, all heat discharged by the heat-emitting section of the heat pump system (via heat exchanger 22) must be dissipated by the supplementary heat exchanger 76**.

To minimize energy consumption, intermittent compressor operation is contemplated when the apparatus is in the solvent "cooling mode". A thermostatic control 100 responsive to coolant temperature is operative to interrupt power to the compressor when a predetermined coolant temperature is reached. In the preferred embodiment, the thermostatic control 100 monitors the temperature of the coolant at the inlet to the heat exchanger 24 and is rendered inoperative during normal apparaus use, that is, when the solvent sump 46 is being heated.

The supplementary heat exchanger 76 also includes a thermostatic control 106 for controlling the heat dissipation rate of the heat exchanger. The control 106 monitors the temperature of the heating fluid at the outlet of the heat exchanger 76 and exerts compensating control on a heat exchanger fan 108 to adjust for temperature fluctuations. In the preferred embodiment, the control 106 is operative in both the solvent heating and the solvent cooling modes of the apparatus. As explained earlier, the supplementary heat exchanger 76 discharges the excess heat from the heat emitting section of the heat pump system. As the heat demand fluctuates, the supplementary heat exchanger 76 modifies the heat exchange rate to maintain a substantially constant heating fluid temperature at its outlet, thereby preserving heat balance in the system.

Two forms of the thermostatic control 106 can be used depending upon the control accuracy desired. The most inexpensive control would be one that comprises a thermostatically controlled switch such as a bi-metallic switch (not shown) that interrupts power to the fan motor when a predetermined temperature is reached. A more expensive, but more accurate control (shown in FIG. 1) is one in which a temperature responsive motor control 106*a* proportionally varies the speed of the fan 108 depending on the temperature of the heating fluid.

It should also be understood that although the disclosed heat exchanger 76 is an air-type heat exchanger, a water exchanger would be equally effective. The thermostatic control for this type of heat exchanger would operate valving for modifying the flow of coolant water through the exchanger to compensate for temperature variations in the heating fluid.

Figure 3:
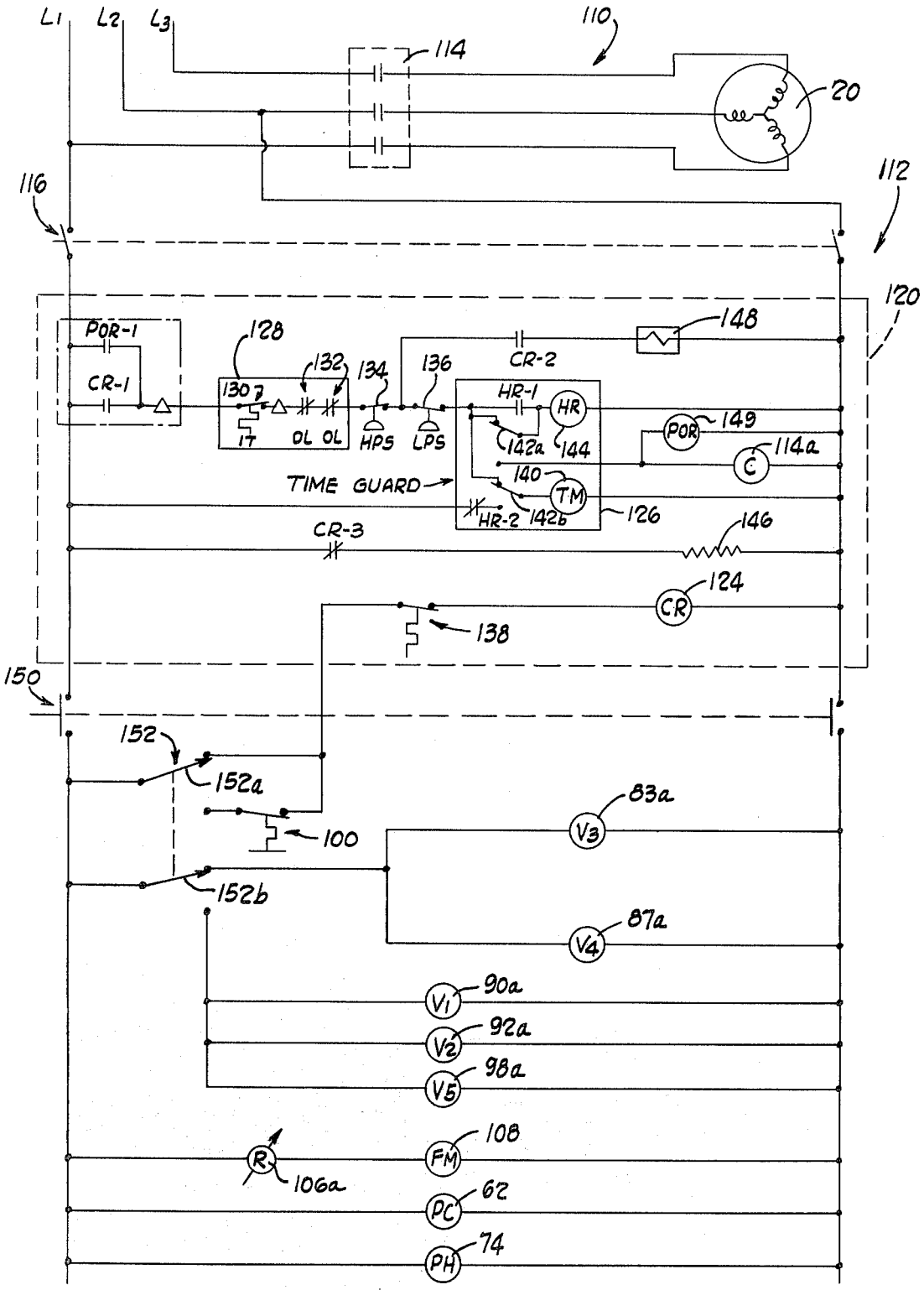
FIG. 3 is a schematic for the control circuitry that controls the apparatus shown in FIG. 1.

FIG. 3 illustrates the circuitry for controlling the apparatus shown in FIG. 1 and comprises a compressor power circuit and a system control circuit indicated generally by the reference characters 110, 112, respectively. As shown, power from input lines $L_1$, $L_2$, $L_3$ is conveyed to the compressor 20 through a three-pole contactor 114. A relay coil 114*a* operates the contactor and forms part of the control circuit 112. Control voltage is supplied from the lines $L_1$, $L_2$ to the control circuit 112 through a double-pole master on/off switch 116.

The control circuit 112 includes a compressor operating circuit, delineated by the broken line 120, that is typically supplied with the compressor by the equipment manufacturer and does not form part of the invention. The operating circuit shown is available from Carrier Corporation and is supplied with their Model 06DE824 compressor.

A summary of the operation of the circuit 120 is as follows. In order to energize the contactor coil 114*a*, a control relay 124 must be energized and a series of equipment protection devices must be in predetermined positions. These protection devices include: a time guard module 126; a terminal box 128 that houses an internal thermostat 130 and serially disposed overload contacts 132; and, pressure responsive switches 134 (HPS), 136 (LPS) which interrupt power to the contactor coil 114*a* if an unusually high or low refrigerant pressure is encountered. A freeze thermostat 138, disposed in series with the control relay 124, deactivates the relay 124 and hence the compressor 20 should system freezing occur.

The time guard module 126 prevents the compressor from restarting until a predetermined interval of time has elapsed since compressor shutdown and thus prevents rapid compressor recycling. The module includes a timer motor 140, a pair of switch contacts 142*a*, 142*b*, and a holding relay 144 having relay contacts HR-1, HR-2. When the switch arms 142*a*, 142*b* are in their upper positions as shown, the contactor coil 114*a* is deenergized. Within a predetermined amount of time after compressor shutdown, the switch arms 142*a*, 142*b* will move to their lower positions and the contactor coil 114*a* will be energized through the relay contacts CR-1 whenever the control relay 124 is energized, provided that none of the equipment safety devices have been activated.

The compressor circuitry 120 also includes a crankcase heater 146 and a liquid line solenoid 148, energized through normally closed contacts CR-3 and normally opened contacts CR-2, respectively, of the control relay 124. The heater 146 and the solenoid 148 inhibit the migration of refrigerant into the compressor crank case (not shown) during compressor idle periods. A pump-out relay 149 (POR), having a normally open contacts POR-1, allows the compressor 20 to shut down only after the refrigerant has been removed from the evaporator. A more complete operational description for the circuit 120 is available from Carrier Corporation.

The communication of power from the lines $L_1$, $L_2$ to the control relay 124 and the remaining portion of the control circuit is controlled by a double pole on/off switch 150 and a double pole mode selector switch 152 having switch arms 152*a*, 152*b*. When the switch 150 is in its "off" position, the control relay 124 and thus the compressor 20 are deenergized along with the lower portion of the circuit 112. When the switch 150 is closed, the fan motor 108, the coolant pump 62 and the heating fluid pump 74 are energized. The fan motor control 106*a* will vary the speed of the fan motor 108 in accordance with temperature changes in the heating fluid.

The position of the mode selector switch 152 determines the mode of operation for the apparatus. When the switch arms 152*a*, 152*b* are in the upper position, as shown, the apparatus is in a "sump heating" mode. In this mode, solenoid coils 83*a*, 87*a*, for the flow control valves 83, 87 are energized, by the switch arm 152*b*, to open the valves to allow heating fluid to flow through the solvent heat exchanger 54. The switch arm 152*a* communicates power directly from the input line $L_1$ to the control relay 124 (through the normally closed freeze thermostat 138).

When the mode selector switch 152 is moved to the lower position, the apparatus is placed in a "sump cooling" mode wherein the solenoids 83*a*, 87*a* are deenergized, closing the valves 83, 87 and solenoid coils 90*a*, 92*a*, 98*a* are energized, thereby opening the valves 90, 92, 98. As explained earlier, in this mode the heating fluid circuit is isolated from the solvent heat exchanger 54 and coolant is conveyed from the coolant circuit to the solvent heat exchanger to effect sump cooling. When in this mode of operation, the switch arm 152*a* places the coolant thermostat 100 in series with the control relay 124 and thus the compressor 20 is shutdown whenever the coolant temperature falls below the temperature setting of the thermostat 100. In this way, intermittent compressor operation is accomplished during the "sump cooling" mode.

Although the invention has been described with a certain degree of particularity, various changes can be made to it without departing from the spirit or scope of the invention as described and herein after claimed.

I claim:

1. A method for providing heating and cooling for an apparatus for cleaning or phosphatizing metals said apparatus containing a stabilizing liquid solvent having a low-boiling point, such as methylene chloride or the like, comprising the steps of:

(a) providing a reservoir of liquid solvent and a zone of solvent vapor above said liquid solvent;

(b) providing a heat pump system having a heat-emitting section and a heat-absorbing section both disposed outside of said liquid reservoir;

(c) transferring heat from said heat-emitting section of said heat pump system to said liquid reservoir by circulating a heat transfer medium between said section and said reservoir;

(d) providing a vapor condenser a predetermined distance above said liquid reservoir to condense vaporized solvent and establish a saturated solvent vapor zone; and, (e) cooling said vapor condenser with a heat-conveying fluid circulatory system communicating between said condenser and said heat-absorbing section of said heat pump system, further characterized in that said liquid reservoir is cooled during periods of non-use by diverting heat-conveying fluid from said condenser and circulating said fluid through said reservoir of said liquid solvent.

2. A method of operating a vapor degreaser which utilizes a low boiling point solvent such as methylene chloride or the like, comprising the steps of:

(a) Providing a reservoir of liquid solvent and a zone of solvent vapor above said reservoir;

(b) heating said reservoir of liquid solvent by transferring heat from an external refrigerant condenser of a heat pump system by utilizing a heat conveying fluid circulatory system communicating with said reservoir;

(c) condensing vaporized solvent a predetermined distance above said liquid reservoir, to provide a saturated solvent vapor zone, by transferring heat from said condensing vapor to a heat-absorbing section of a heat pump system utilizing a heat conveying fluid circulatory system; and, (d) circulating fluid of said heat-conveying fluid circulatory systems through reservoirs so that heat demand fluctuations in said apparatus have little effect on said heat pump system, further characterized in that said liquid reservoir is cooled during periods of degreaser non-use by diverting heat conveying fluid used for cooling said condensing vapor, to said reservoir of liquid solvent.

3. Apparatus for vapor degreasing or phosphatizing with stabilized methylene chloride, comprising:

(a) a vessel for a liquid reservoir of said methylene chloride and providing a zone for solvent vapor above said liquid reservoir;

(b) a heat exchanger in said vessel at a location to be immersed in said liquid reservoir for heating said solvents;

(c) a vapor condenser in said vessel disposed in the zone for solvent vapor;

(d) a heat pump system having a heat-emitting section and a heat-absorbing section for heating and cooling a heat exchange medium for said solvent heat exchanger and vapor condenser, respectively;

(e) a fluid handling system for circulating said heat exchange medium including conduits for circulating the medium between the heat-emitting section of said heat pump system and said solvent heat exchanger, and for circulating fluid between the heat-absorbing section of said heat pump system and said vapor condenser; and, (f) means including fluid reservoirs in said fluid handling system, for inhibiting loss of thermal equilibrium in said heat pump system caused by temporary fluctuations in heating and cooling demand of said apparatus, further characterized in that a means for diverting cooling fluid from said vapor condenser to said solvent heat exchanger for cooling said reservoir to inhibit solvent evaporation during apparatus non-use is provided.

4. Apparatus for vapor degreasing or phosphatizing with a solvent having a boiling point in the range of about 80° F. to 130° F., comprising;

(a) a vessel for a reservoir of liquid solvent and having a zone for containing solvent vapor above said liquid solvent;

(b) a solvent heater in the vessel at a level to be immersed in said liquid solvent;

(c) a vapor condenser in said solvent vapor zone of said vessel for containing vaporized solvent;

(d) means including heat transfer fluid for heating and cooling said solvent heater and vapor condenser, respectively; and, (e) means for diverting heat transfer fluid from said vapor condenser and circulating said fluid through said reservoir to cool said reservoir of liquid solvent to inhibit solvent evaporation during apparatus non-use, further characterized in that said means for diverting heat transfer fluid from said vapor condenser circulates said fluid through said solvent heater.

5. Apparatus for vapor degreasing or phosphatizing with a solvent having a boiling point in a range of about 80° F. to 130° F., comprising:

(a) a vessel for a reservoir of liquid solvent and having a zone for containing solvent vapor above said liquid solvent;

(b) a solvent heater in said vessel at a level to be immersed in said liquid solvent;

(c) a vapor condenser in said solvent vapor zone of said vessel for condensing vaporized solvent;

(d) means including heat transfer fluid for heating and cooling said solvent heater and vapor condenser, respectively; and, (e) means for diverting heat transfer fluid from said vapor condenser and circulating said fluid through said reservoir to cool said reservoir of liquid solvent to inhibit solvent evaporation during apparatus non-use, further characterized in that said heating and cooling means is provided by a heat pump system having a heat-emitting section and a heat-absorbing section located outside of said vessel and wherein said heat transfer fluid transfers heat between said vapor condenser and said heat-absorbing section and between said heat-emitting section and said solvent heater.

6. Apparatus for vapor degreasing or phosphatizing with a solvent having a boiling point in the range of about 80° F. to 130° F., comprising:

(a) a vessel for a reservoir of liquid solvent and having a zone for containing solvent vapor above said liquid solvent;

(b) a solvent heater in said vessel at a level to be immersed in said liquid solvent;

(c) a vapor condenser in said solvent vapor zone of said vessel for condensing vaporized solvent;

(d) a heat pump system having heat-emitting and heat-absorbing sections;

(e) a first fluid handling system for circulating a coolant fluid between said heat-absorbing section and said vapor condenser;

(f) a second fluid handling system for circulating a heating fluid between said heat-emitting section and said solvent heater in said vessel, further characterized in that a valve and conduit means are provided for diverting at least a portion of said coolant fluid from said vapor condenser and circulating said coolant fluid through said solvent reservoir to cool said reservoir to inhibit solvent evaporation during apparatus nonuse.

7. The apparatus as claimed in claims 1 or 2: wherein the heat conveying fluid circulatory system comprises conduit means and a reservoir sized so that the mass of coolant fluid in said circulatory system is substantially equal to the expression $(M_sC_s\Delta T_s+M_{HF}C_{HF}\Delta T_{HF})$ $C_c\Delta T_c$ multiplied by a heat pump efficiency factor having a range of 1.0 to 0.5, where $M_s$ and $M_{HF}$ are the mass of the solvent and heating fluid, respectively, $C_s$, $C_{HF}$, and $C_c$ are the specific heats of the solvent, heating fluid, and coolant fluid respectively, and $\Delta T_s$, $\Delta T_{HF}$, and $\Delta T_c$ are the temperature changes from an ambient temperature that occurs in the solvent, heating fluid, and coolant fluid respectively, during an apparatus start-up phase of operation.

* * * * *

UNITED STATES PATENT AND TRADEMARK OFFICE

CERTIFICATE OF CORRECTION

PATENT NO. : 4,322,251

DATED : March 30, 1982

INVENTOR(S) : Douglas R. Elliott

It is certified that error appears in the above-identified patent and that said Letters Patent is hereby corrected as shown below:

Column 16, line 17, claim 7, the formula should read

-- $(M_s C_s \Delta T_s + M_{HF} C_{HF} \Delta T_{HF} / C_c \Delta T_c)$ --.

Signed and Sealed this

*Twentieth* Day of *July 1982*

[SEAL]

*Attest:*

GERALD J. MOSSINGHOFF

*Attesting Officer*

*Commissioner of Patents and Trademarks*